US010076457B2

(12) United States Patent
Behm

(10) Patent No.: US 10,076,457 B2
(45) Date of Patent: Sep. 18, 2018

(54) PROPULSION ATTACHMENT FOR A MANUAL WHEELCHAIR

(71) Applicant: Eric J. Behm, Oroville, CA (US)

(72) Inventor: Eric J. Behm, Oroville, CA (US)

(73) Assignee: Eric Behm, Oroville, CA (US)

( * ) Notice: Subject to any disclaimer, the term of this patent is extended or adjusted under 35 U.S.C. 154(b) by 0 days.

(21) Appl. No.: 15/225,663

(22) Filed: Aug. 1, 2016

(65) Prior Publication Data

US 2018/0028378 A1 Feb. 1, 2018

(51) Int. Cl.

| | |
|---|---|
| ***A61G 5/10*** | (2006.01) |
| ***A61G 5/04*** | (2013.01) |
| ***A61G 5/02*** | (2006.01) |

(52) U.S. Cl.

CPC ..... *A61G 5/042* (2013.01); *A61G 5/025* (2013.01); *A61G 5/047* (2013.01); *A61G 5/1005* (2013.01)

(58) Field of Classification Search

CPC ..... A61G 5/042; A61G 5/047; A61G 5/1035; A61G 5/021; A61G 5/027

See application file for complete search history.

(56) References Cited

U.S. PATENT DOCUMENTS

| | | | | |
|---|---|---|---|---|
| 5,050,695 | A * | 9/1991 | Kleinwolterink, Jr. | A61G 5/047 180/13 |
| 5,113,959 | A | 5/1992 | Mastov et al. | |
| 5,351,774 | A * | 10/1994 | Okamoto | A61G 5/047 180/11 |
| 6,027,132 | A * | 2/2000 | Robinson | A61G 5/00 16/19 |
| 6,290,011 | B1 * | 9/2001 | Langaker | A61G 5/042 180/329 |
| 6,860,347 | B2 | 3/2005 | Sinclair et al. | |
| 7,174,093 | B2 * | 2/2007 | Kidd | A61G 5/047 180/58 |
| 7,673,715 | B2 | 3/2010 | Takechi | |
| 7,694,991 | B2 | 4/2010 | Mills et al. | |
| 8,132,634 | B1 * | 3/2012 | Flowers | A61G 5/043 180/19.3 |
| 8,388,010 | B2 * | 3/2013 | Butts | A61G 5/027 280/250.1 |
| 8,430,189 | B2 | 4/2013 | Tallino | |
| 2004/0000440 | A1 * | 1/2004 | Sawyer | A61G 5/047 180/13 |
| 2012/0080243 | A1 | 4/2012 | Mulhern | |
| 2015/0351979 | A1 * | 12/2015 | Conte | A61G 5/047 180/13 |
| 2016/0120715 | A1 * | 5/2016 | Farmer | A61G 5/1059 280/648 |

* cited by examiner

*Primary Examiner* — James A English
(74) *Attorney, Agent, or Firm* — Jean Nguyen

(57) ABSTRACT

This relates to a propulsion attachment for a manual wheelchair and methods of operation. The propulsion attachment can include three wheels, a motor, a gearbox, and a handlebar. The propulsion attachment can attach to the footrest of the wheelchair using a pin. The motor can be located in the rear side of the propulsion attachment and can push the user in a forward direction. Alternatively, the user can manipulate a switch located on the handlebar to allow the propulsion attachment to pull the user in a reverse direction. The propulsion attachment can include a plurality of brakes, where each brake can control one of the wheels. Additionally, the propulsion attachment can operate at variable speeds using the motor and the power from one or both batteries.

14 Claims, 15 Drawing Sheets

PROPULSION ATTACHMENT FOR A MANUAL WHEELCHAIR

FIELD

This relates generally to a wheelchair, and more specifically, a propulsion attachment for a manual wheelchair.

BACKGROUND

Manual wheelchairs can have many benefits, such as cost, size, and maneuverability, over motorized wheelchairs. There can be instances when the user may want to utilize some of the benefits (e.g., power) of motorized wheelchairs. A drive attachment can be used to provide power to the manual wheelchairs, giving the user enhanced ability to traverse up or down inclines and to propel for long distances. Different drive attachments can include a motorized hub, an attendant-controlled power drive unit, and a joystick-controlled power assist device. However, these devices may have limited user control, maneuverability, stability, power, comfort, and portability; thus, a propulsion attachment with one or more of these features may be desired.

SUMMARY

This relates to a propulsion attachment for a manual wheelchair and methods of operation. The propulsion attachment can include three wheels, a motor, a gearbox, and a handlebar. The propulsion attachment can attach to the footrest of the wheelchair using a pin. The propulsion attachment can be capable of standing upright when detached from the wheelchair. The motor can be located in the rear side of the propulsion attachment and can push the user in a forward direction. Alternatively, the user can manipulate a switch located on the handlebar to allow the propulsion attachment to pull the user in a reverse direction. The propulsion attachment can include a plurality of brakes, where each brake can be control one of the wheels. Additionally, the propulsion attachment can operate at variable speeds using the motor and the power from one or both batteries. In some examples, the propulsion attachment can be partially located underneath the seat of the wheelchair to minimize a footprint of the system (i.e., propulsion attachment and wheelchair). In some examples, the handlebar and a controller can be located towards the front of the propulsion attachment allowing the user full control of the system.

BRIEF DESCRIPTION OF THE DRAWINGS

FIGS. 3A-1 to 3A-2 illustrate an exemplary process for forming the propulsion attachment according to examples of the disclosure.

DETAILED DESCRIPTION

Figure 1:
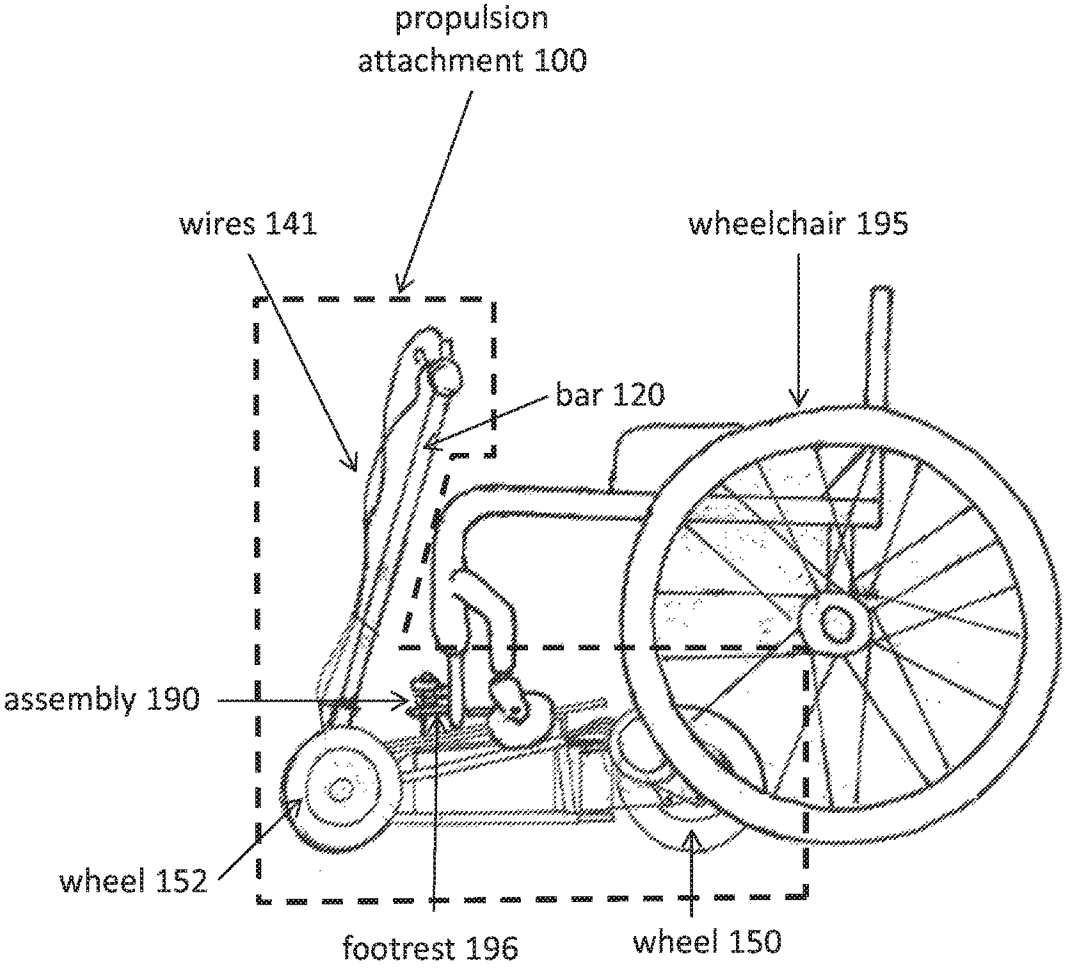
FIG. 1 illustrates a side view of a propulsion attachment and manual wheelchair according to examples of the disclosure.
Figure 2A:
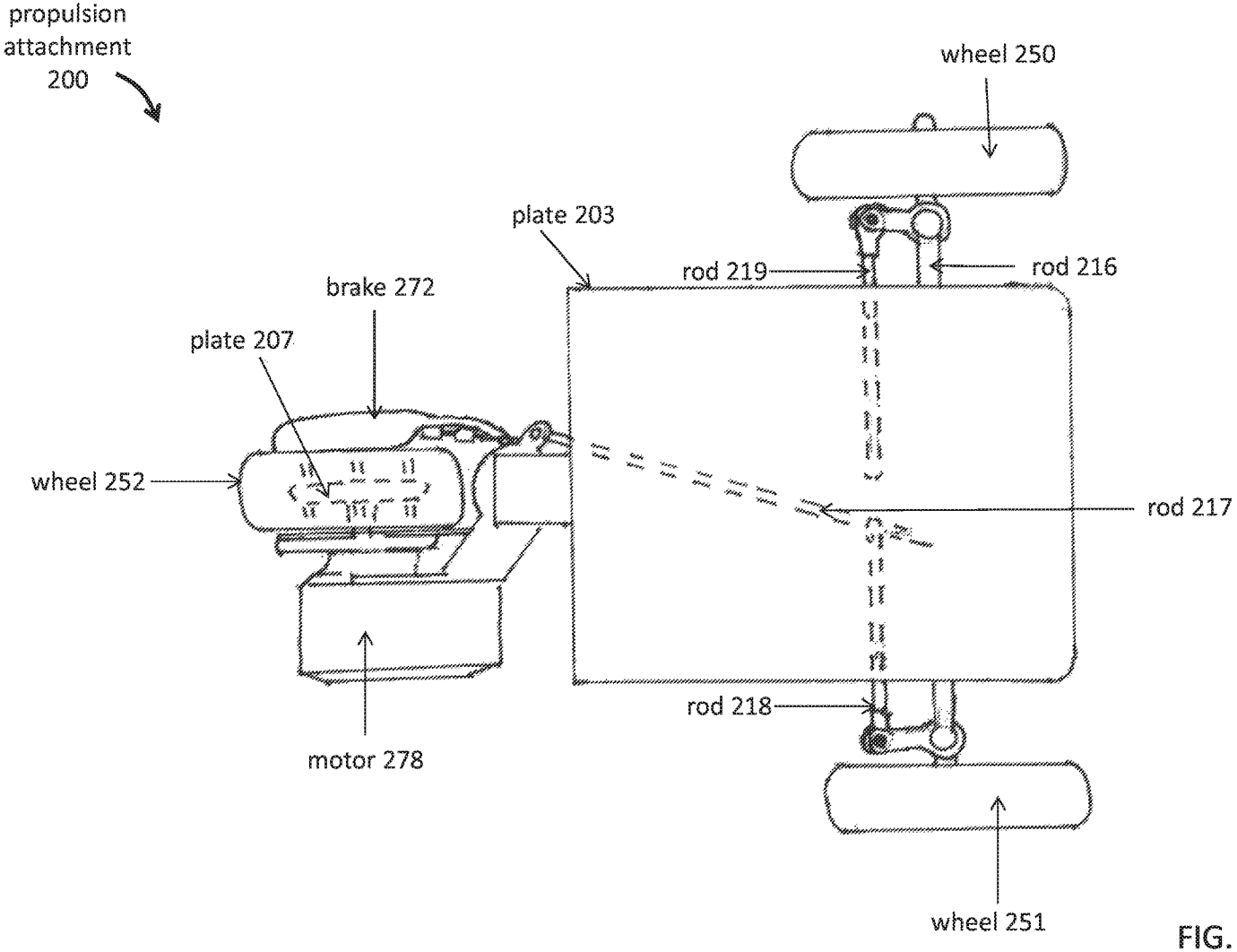
FIG. 2A illustrates a bottom view of a propulsion attachment according to examples of the disclosure.
Figure 2B:
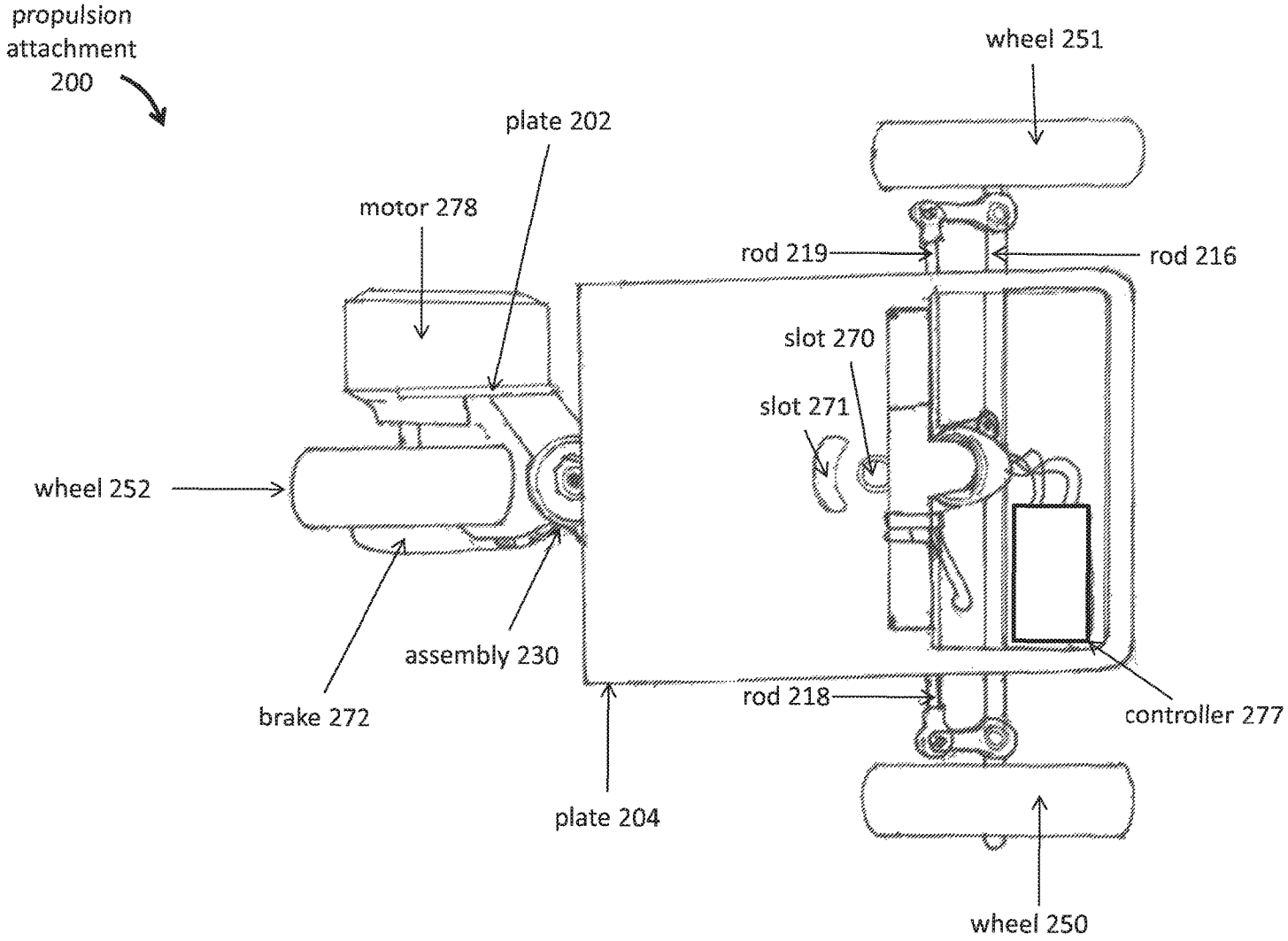
FIG. 2B illustrates a top view of a propulsion attachment according to examples of the disclosure.
Figure 2C:
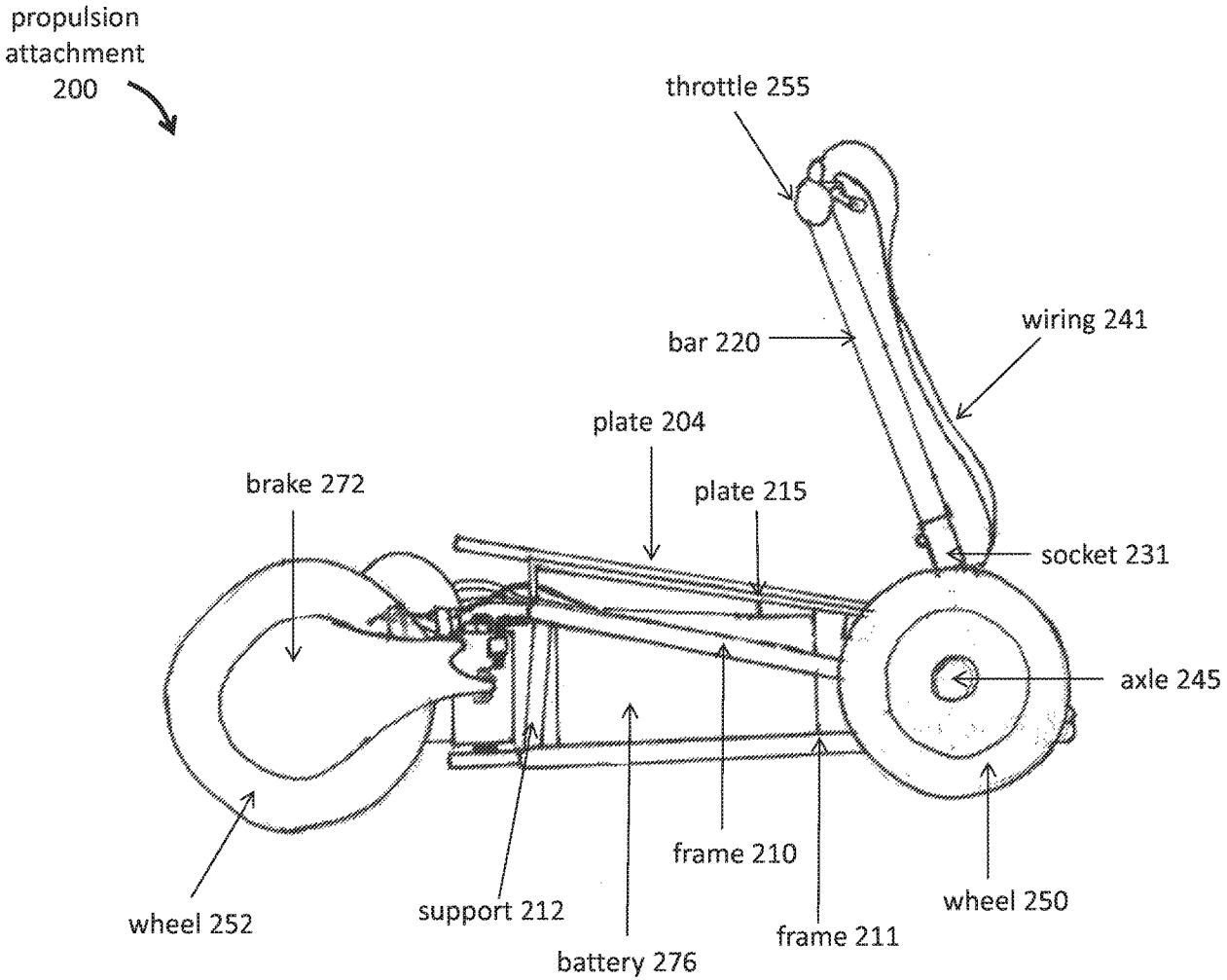
FIGS. 2C-2D illustrate side views of a propulsion attachment according to examples of the disclosure.
Figure 2D:
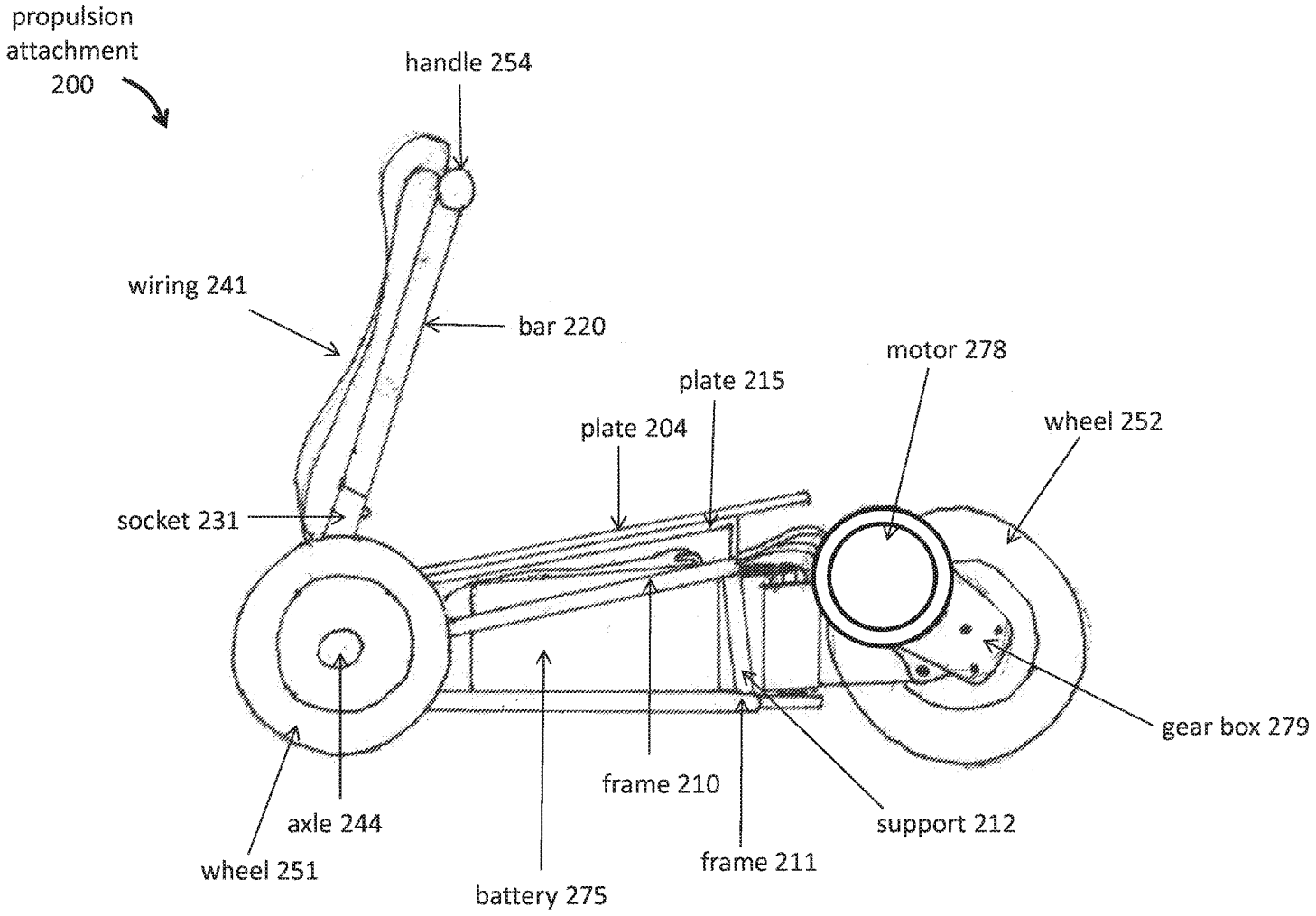
Figure 2E:
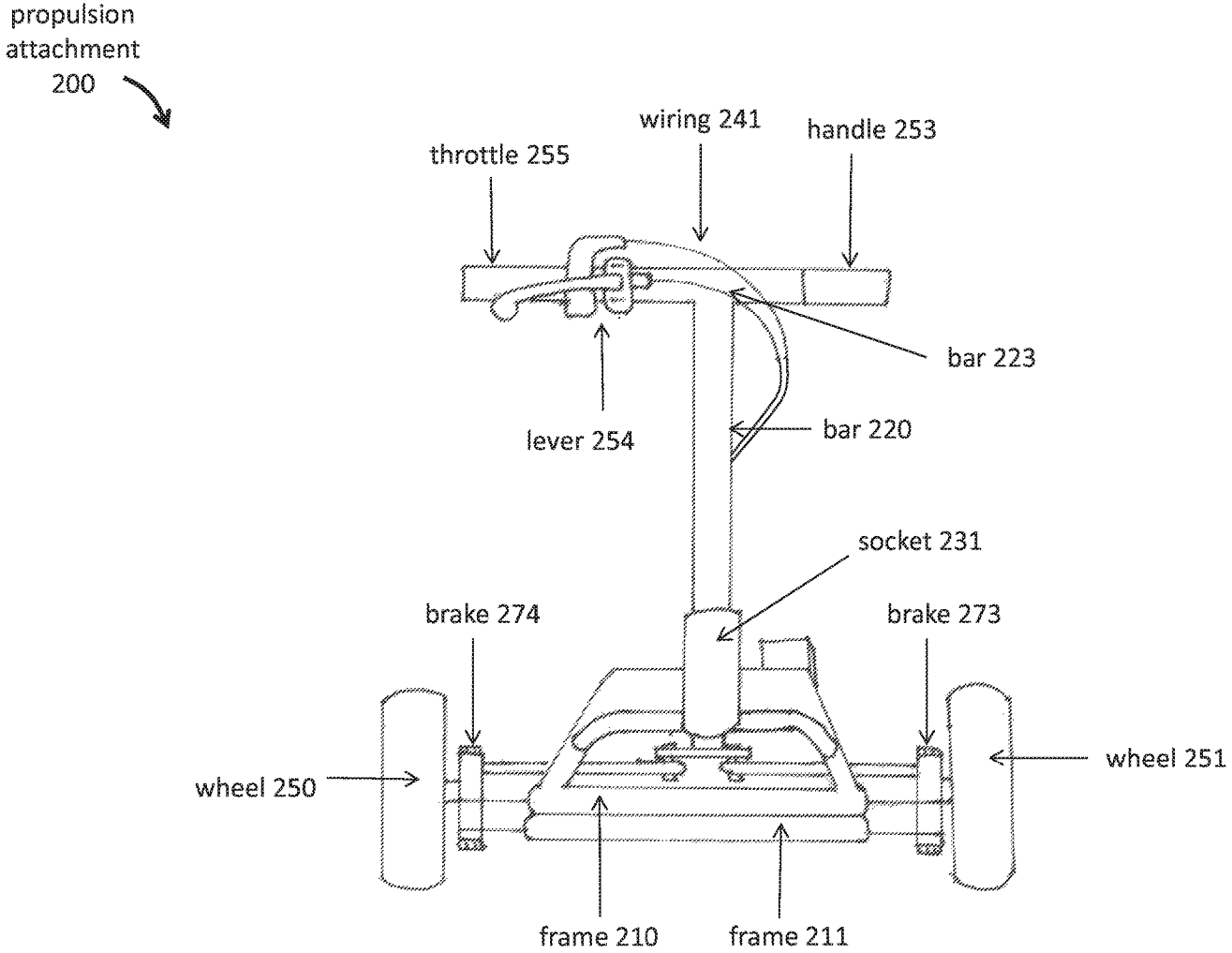
FIG. 2E illustrates a front view of a propulsion attachment according to examples of the disclosure.
Figure 2F:
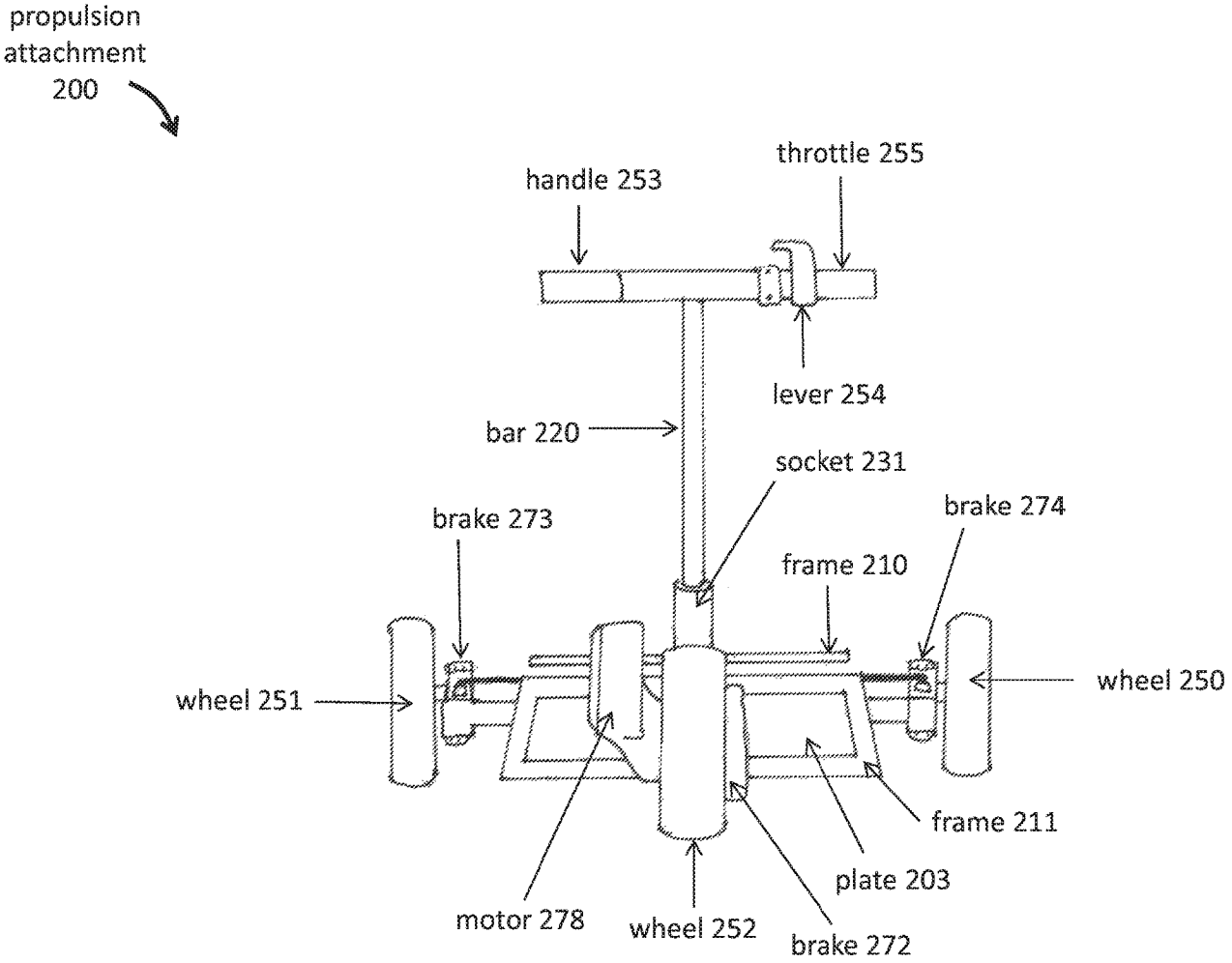
FIG. 2F illustrates a rear view of a propulsion attachment according to examples of the disclosure.
Figure 2G:
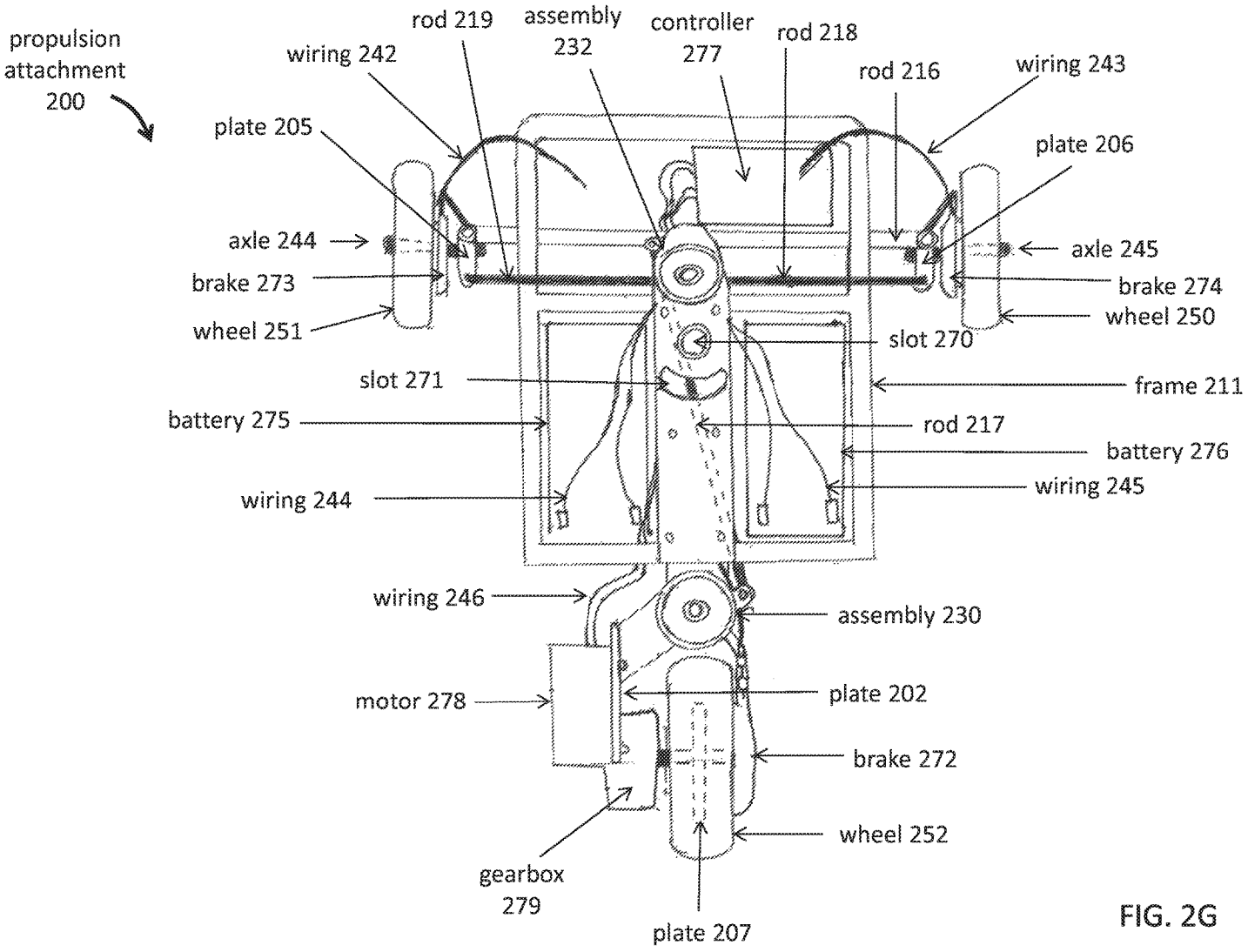
FIG. 2G illustrates a top view of a propulsion attachment according to examples of the disclosure.

In the following description of examples, reference is made to the accompanying drawings in which it is shown by way of illustration specific examples that can be practiced. It is to be understood that other examples can be used and structural changes can be made without departing from the scope of the various examples.

Various techniques and process flow steps will be described in detail with reference to examples as illustrated in the accompanying drawings. In the following description, numerous specific details are set forth in order to provide a thorough understanding of one or more aspects and/or features described or referenced herein. It will be apparent, however, to one skilled in the art, that one or more aspects and/or features described or referenced herein may be practiced without some or all of these specific details. In other instances, well-known process steps and/or structures have not been described in detail in order to not obscure some of the aspects and/or features described or referenced herein.

Further, although process steps or method steps can be described in a sequential order, such processes and methods can be configured to work in any suitable order. In other words, any sequence or order of steps that can be described in the disclosure does not, in and of itself, indicate a requirement that the steps be performed in that order. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modification thereto, does not imply that the illustrated process or any of its steps are necessary to one or more of the examples, and does not imply that the illustrated process is preferred.

This relates to a propulsion attachment for a manual wheelchair and methods of operation. The propulsion attachment can include three wheels, a motor, a gearbox, and a handlebar. The propulsion attachment can attach to the footrest of the wheelchair using a pin. The propulsion attachment can be capable of standing upright when detached from the wheelchair. The motor can be located in the rear side of the propulsion attachment and can push the user in a forward direction. Alternatively, the user can manipulate a switch located on the handlebar to allow the propulsion attachment to pull the user in a reverse direction. The propulsion attachment can include a plurality of brakes, where each brake can control one of the wheels. Additionally, the propulsion attachment can operate at variable speeds using the motor and the power from one or both batteries. In some examples, the propulsion attachment can be partially located underneath the seat of the wheelchair to minimize the footprint of the system (i.e., propulsion attachment and wheelchair). In some examples, the handlebar and a controller can be located towards the front of the propulsion attachment allowing the user full control of the system.

Representative applications of methods and apparatus according to the present disclosure are described in this section. These examples are being provided solely to add context and aid in the understanding of the described examples. It will thus be apparent to one skilled in the art that the described examples may be practiced without some or all of the specific details. In other instances, well-known process steps have been described in detail in order to avoid unnecessarily obscuring the described examples. Other applications are possible, such that the following examples should not be taken as limiting.

FIG. 1 illustrates a side view of a propulsion attachment and manual wheelchair according to examples of the disclosure. Propulsion attachment 100 can be attached to wheelchair 195 when in operation. Propulsion attachment 100 can be capable of being detached from wheelchair 195 when not in use. Propulsion attachment 100 can include a plurality of wheels, footrest 196, assembly 190, wires 141, and bar 120. The plurality of wheels can include wheel 150 and wheel 152, which can be any type of component capable of rotating along an axle. The plurality of wheels can include a third wheel (not shown) that can be operated in conjunction with the wheels on wheelchair 195 to allow movement of the user. In some examples, the spacing between wheels (e.g., wheels, including wheel 152, located on the opposite side of propulsion attachment 100 than wheel 150) can be greater than the spacing between the front wheels of wheelchair 195. In this manner, propulsion attachment 100 can enhance turning stability.

Footrest 196 can be capable of providing a platform for the user to rest feet, objects, pets, or the like. Assembly 190 can be any type of mechanism capable of attaching propulsion attachment 100 to wheelchair 195. In some examples, when propulsion attachment 100 is attached to wheelchair 195, the front wheels of wheelchair 195 can be "floating" (i.e., not making contact with the same surface, such as ground, that the rear wheels of the wheelchair are contacting).

Wires 141 can be electrical wires capable of routing one or more electrical signals. The electrical signals can include control inputs routed from one or more buttons or levers interfacing with the user to a control box (not shown). Bar 120 can be any type of bar capable of supporting the user and/or allowing the user to steer propulsion attachment 100 and wheelchair 195.

FIGS. 2A-2G illustrate bottom, top, sides, front, and rear views of the propulsion attachment attached to a wheelchair according to examples of the disclosure. Propulsion attachment 200 can be capable of standing upright when detached from the wheelchair. Propulsion attachment 200 can comprise a plurality of wheels and axles, a plurality of structural components, motor 278, gearbox 279, controller 277, a plurality of batteries, a handlebar, and a plurality of wires. The plurality of wheels can comprise wheel 250, wheel 251, and wheel 252. The plurality of wheels can be any type of component capable of rotating along an axle, such as axle 244 or axle 245. Wheel 250 and wheel 251 can be located towards the front (i.e., side furthest away from the wheelchair) of propulsion attachment 200, where the wheels can be located on opposite sides of the handlebar. Wheel 252 can be located towards the back (i.e., side closest to the wheelchair). In some examples, two or more of the wheels can be different sizes. In some examples, the front wheels (e.g., wheel 250 and wheel 251) can be 4" in size with pneumatic 200×50 tires. For example, wheel 250 and wheel 251 can have the same diameter, whereas wheel 252 can have a different (e.g., larger) diameter. Axle 244 can be connected to wheel 251, and axle 245 can be connected to wheel 250.

The plurality of wheels and axles can be connected to a plurality of rods, such as rod 216, rod 217, rod 218, and rod 219. Rod 216 can be included in one or more axles (e.g., axle 244 and/or axle 245). Rod 218 can be connected to rod 216 using plate 206, and rod 219 can be connected to rod 216 using plate 205. In some examples, plate 205 and plate 206 can be 1" squares. Both rod 218 and rod 219 can be configured to provide structural support to rod 216 when propulsion attachment 200 is turning and/or maneuvering. In some examples, rod 216 can be equal in length to the total length of rod 218 and 219 combined. In some examples, rod 216, rod 218, and rod 219 can include the same diameter tubing. Rod 217 can connect rod 218 and rod 219 to assembly 230. In some examples, one or more of rod 216, rod 217, rod 218, and rod 219 can include ⅜" tubing. In some examples, rod 217, rod 218, and rod 219 can be 5/16" threaded rods.

The plurality of wheels can be coupled to the plurality of brakes. The plurality of brakes can include brake 272, brake 273, and brake 274. Brake 272 can be coupled to wheel 252; brake 273 can be coupled to wheel 251; and brake 274 can be coupled to wheel 250. In some examples, at least two of the brakes can be the same type of brakes and/or be the same size. In some examples, at least two of the brakes can be different types of brakes and/or be different sizes. For example, brake 273 and brake 274 can have a smaller diameter than brake 272.

The plurality of structural components can include frame 210 and frame 211. In some examples, frame 210 and/or frame 211 can include ⅜" tubing. In some examples, the frame 210 and/or frame 211 can be two 2' squares. Frame 210 can be located above the batteries, and frame 211 can be located below the batteries. Frame 210 can be configured to support plate 204 and plate 215, and frame 211 can be configured to support plate 203. Support 212 can be capable of providing mechanical support to frame 210 and plate 204, physically separating frame 210 from frame 211 and/or providing protection to the batteries. In some examples, propulsion attachment 200 can include two supports 212, where each support can be located in the corners of frame 210 and frame 211 towards the rear side (e.g., opposite side than handlebar). In some examples, support 212 can create a 1" gap between frame 210 and frame 211.

Plate 203, plate 204, and plate 215 can be any type of plate or piece of material. In some examples, plate 203 can be a 1/16" skid plate. In some examples, plate 204 can be a deck plate. Plate 204 and plate 215 can include one or more openings, such as slot 270 and slot 271. The one or more openings can be configured to allow one or more structures to pass through. In some examples, plate 215 can include a 1½"×⅛" thick flat bar.

Motor 278 can be any type of machine that provides power to propulsion attachment 200. For example, motor 278 can provide power to rotate wheel 252, allowing propulsion attachment to push the wheelchair (e.g., wheelchair 195). In some examples, motor 278 can be a 500 watt motor. Gearbox 279 can include one or more gears configured to transfer energy from motor 278 to wheel 252. Gearbox 279 can be supported by plate 202. In some examples, plate 202 can be a motor mount plate. In some examples, plate 202 can be a ⅛" metal plate. Controller 277 can be any type of processor or circuitry configured to transmit and/or process one or more signals or information received by the user. Motor 278 can receive power from the plurality of batteries, such as battery 275 and battery 276. In some examples, battery 275 and battery 276 can be 6"×3"×4" batteries. In some examples, battery 275 and battery 276 can be 12 volt batteries. In some examples, battery 275 and battery 276 can be located in sealed carrying pouches.

The handlebar can be any type of mechanism capable of allowing the user to turn or maneuver propulsion attachment 200. The handlebar can include handle 253, bar 220, bar 223, throttle 255, and lever 254. Handle 253 and throttle 255 can be configured to allow the user to rest on, grip or hold the handlebar. Handle 253 can be configured to allow the user to turn and maneuver propulsion attachment 200 and the wheelchair. In some examples, the handlebar can include one or more mechanisms for switching between movement in the forward and reverse direction. Throttle 255 can be any type of component capable of allowing the user control of the speed of propulsion attachment 200. In some examples, propulsion attachment 200 can be capable of operating at variable speeds. For example, the user can rotate throttle 255 clockwise to increase the speed. In some examples, throttle 255 can be an electronic twist handle throttle. In some examples, lever 254 can be a brake lever configured to allow the user to apply one or more brakes (e.g., brake 272, brake 274, and brake 273) to one or more wheels, thereby slowing down or decreasing the speed of propulsion attachment 200. In some examples, lever 254 can include a dual brake cable handle. The handlebar can further include bar 220, which can be connected to the remaining structural components, wheels, and motor 278 using socket 231 and assembly 232. In some examples, bar 220 can be a ¾"×3' piece of ⅛" metal tubing. In some examples, bar 223 can be a ½"×2' cross tube.

The plurality of wires can include wiring 241, wiring 242, wiring 243, wiring 244, wiring 245, and wiring 246. The plurality of wires can be configured to transmit one or more electrical signals. For example, wiring 241 can be configured to transmit one or more electrical signals from throttle 255 and/or lever 254 to controller 277. Wiring 242 can be configured to transmit one or more electrical signals from brake 273 to controller 277; wiring 243 can be configured to transmit one or more electrical signals from brake 274 to controller 277. Wiring 246 can be configured to transmit one or more electrical signals from brake 272 to controller 277. Furthermore, wiring 244 and wiring 245 can be configured to transmit one or more electrical signals from battery 275 and battery 276, respectively, to controller 277.

Figures 1, 3A:
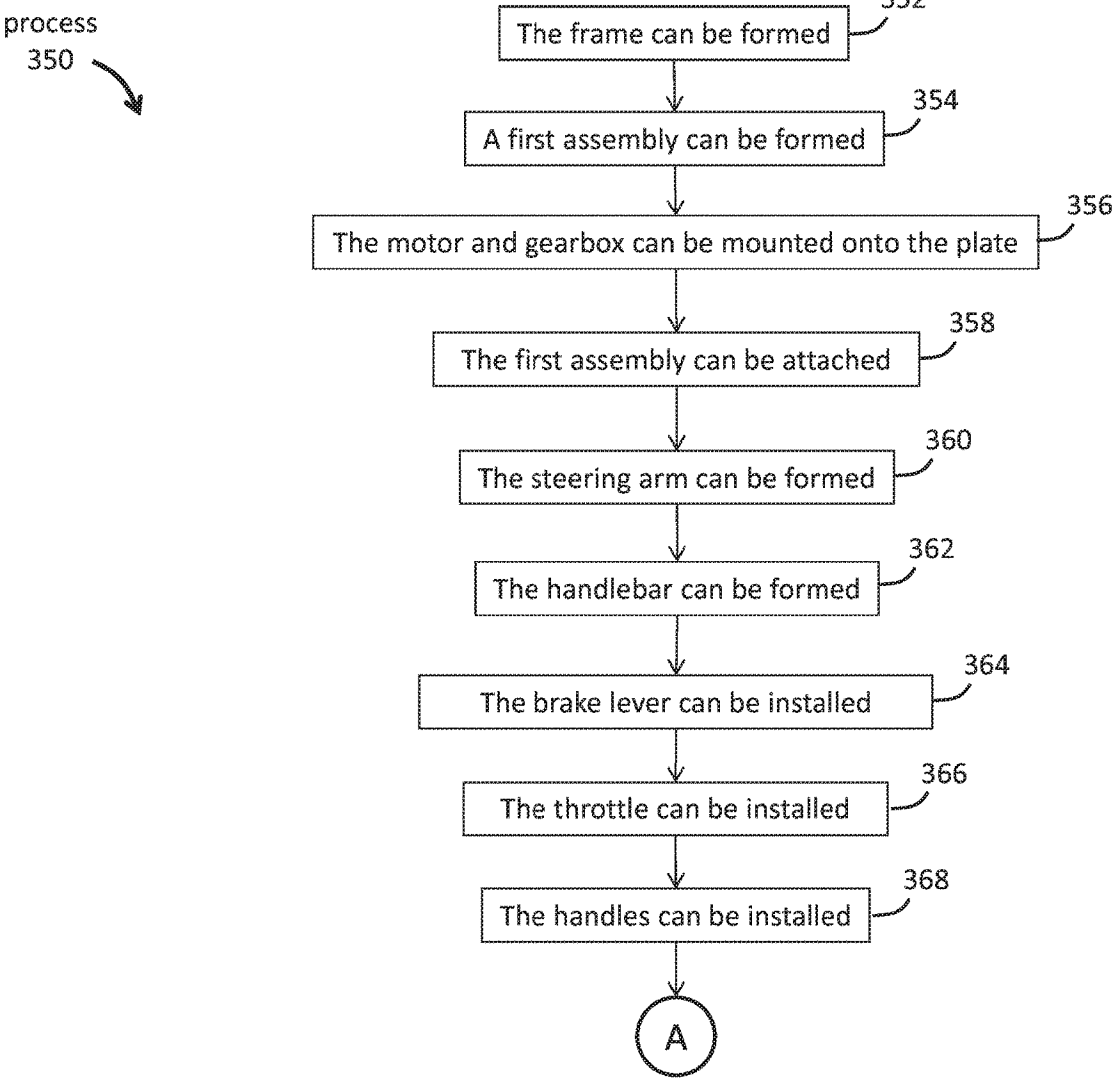
Figures 2, 3A:
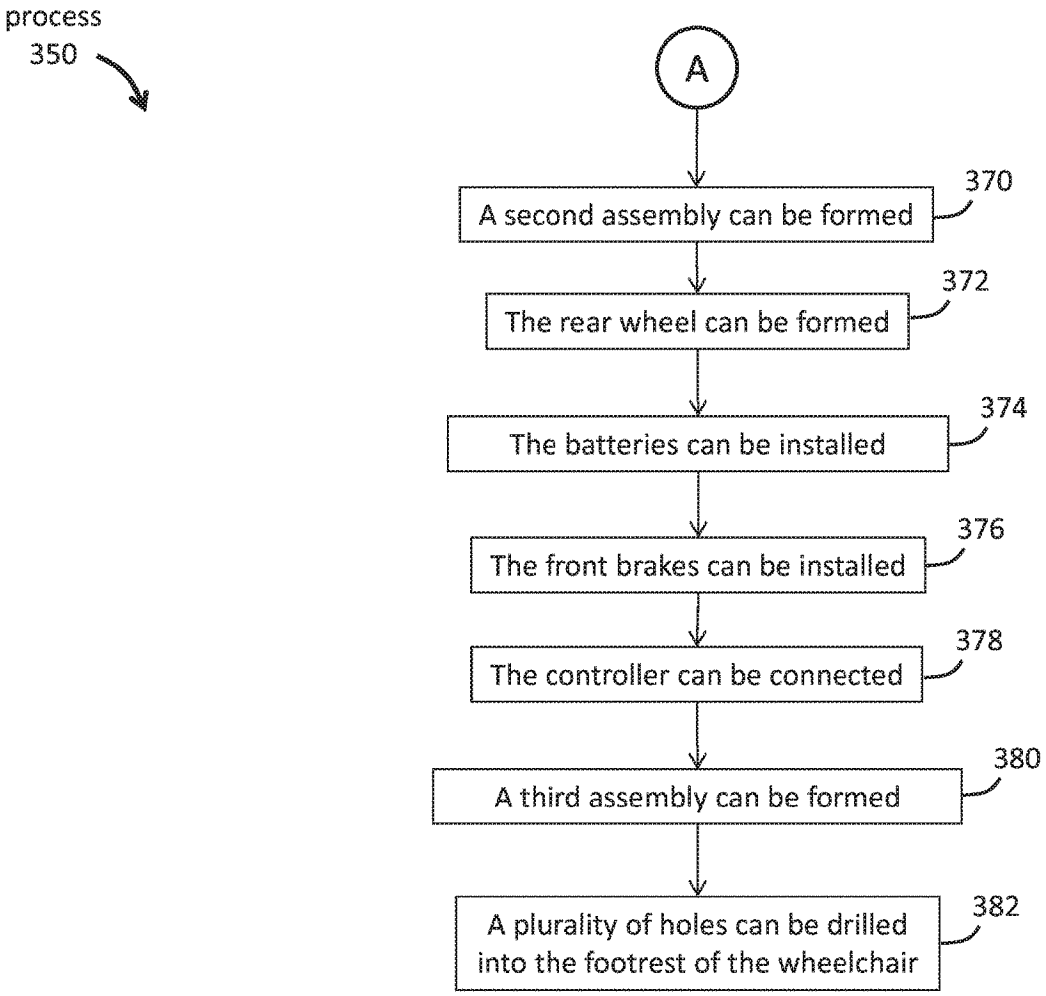
Figure 3B:
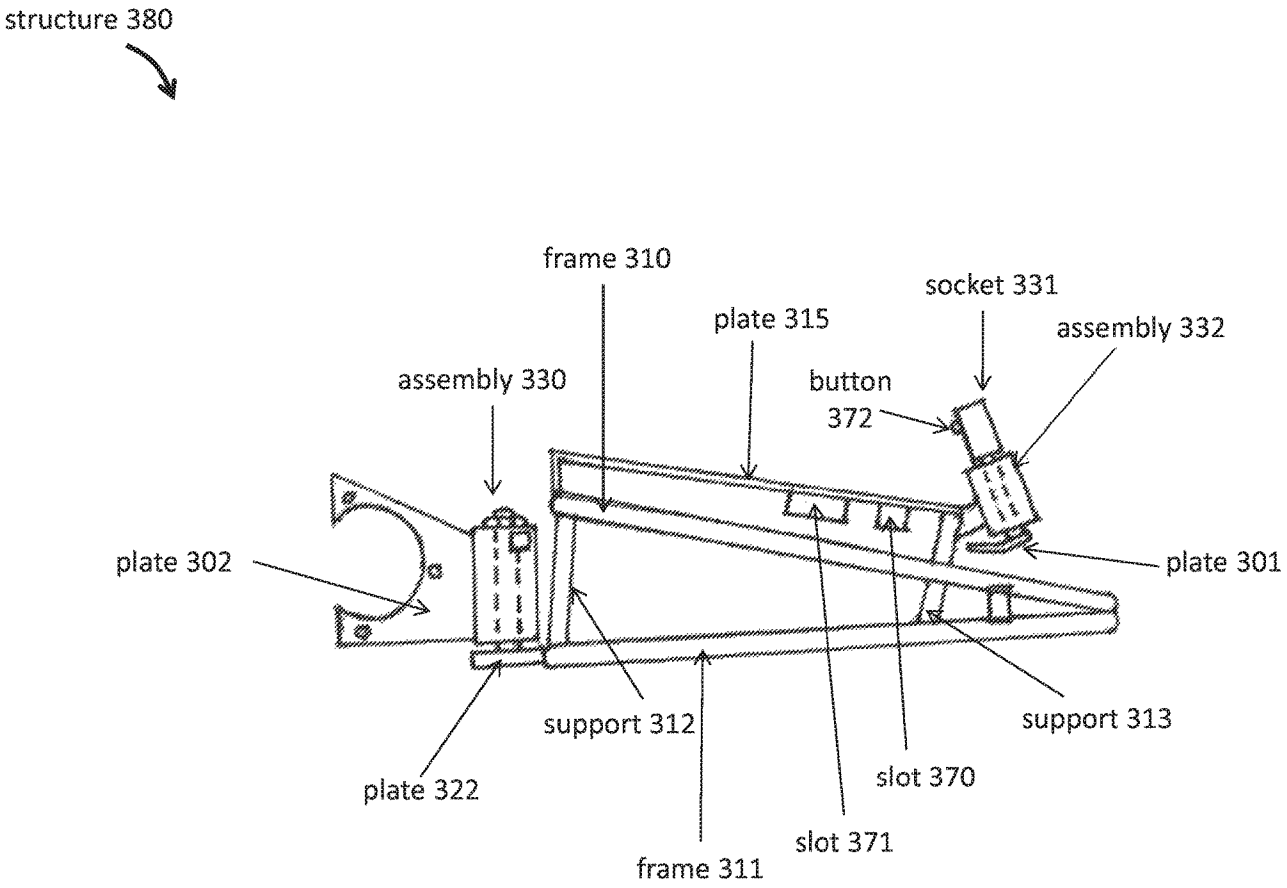
FIGS. 3B-3D illustrate sides and a top view of a propulsion attachment according to examples of the disclosure.
Figure 3C:
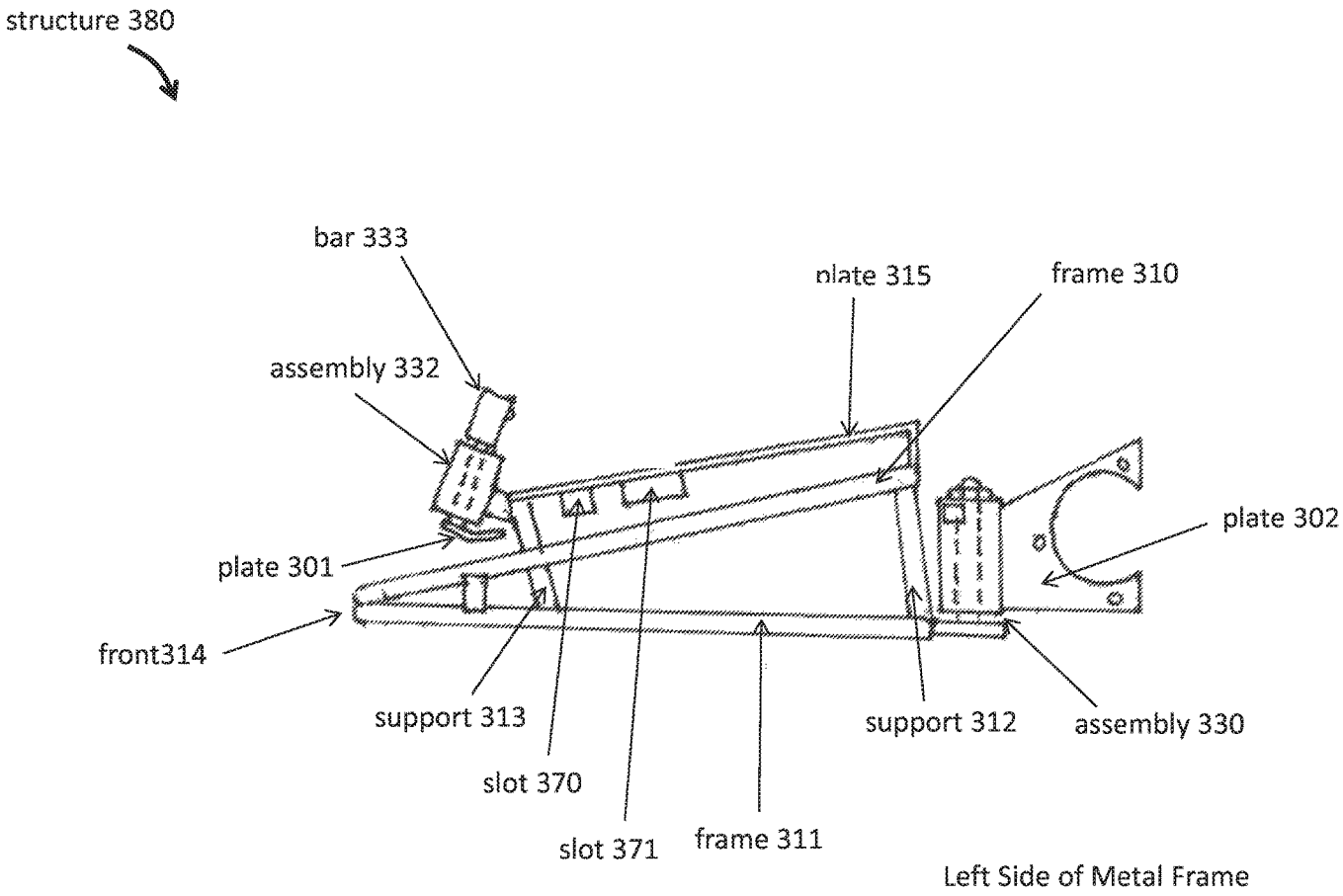
Figure 3D:
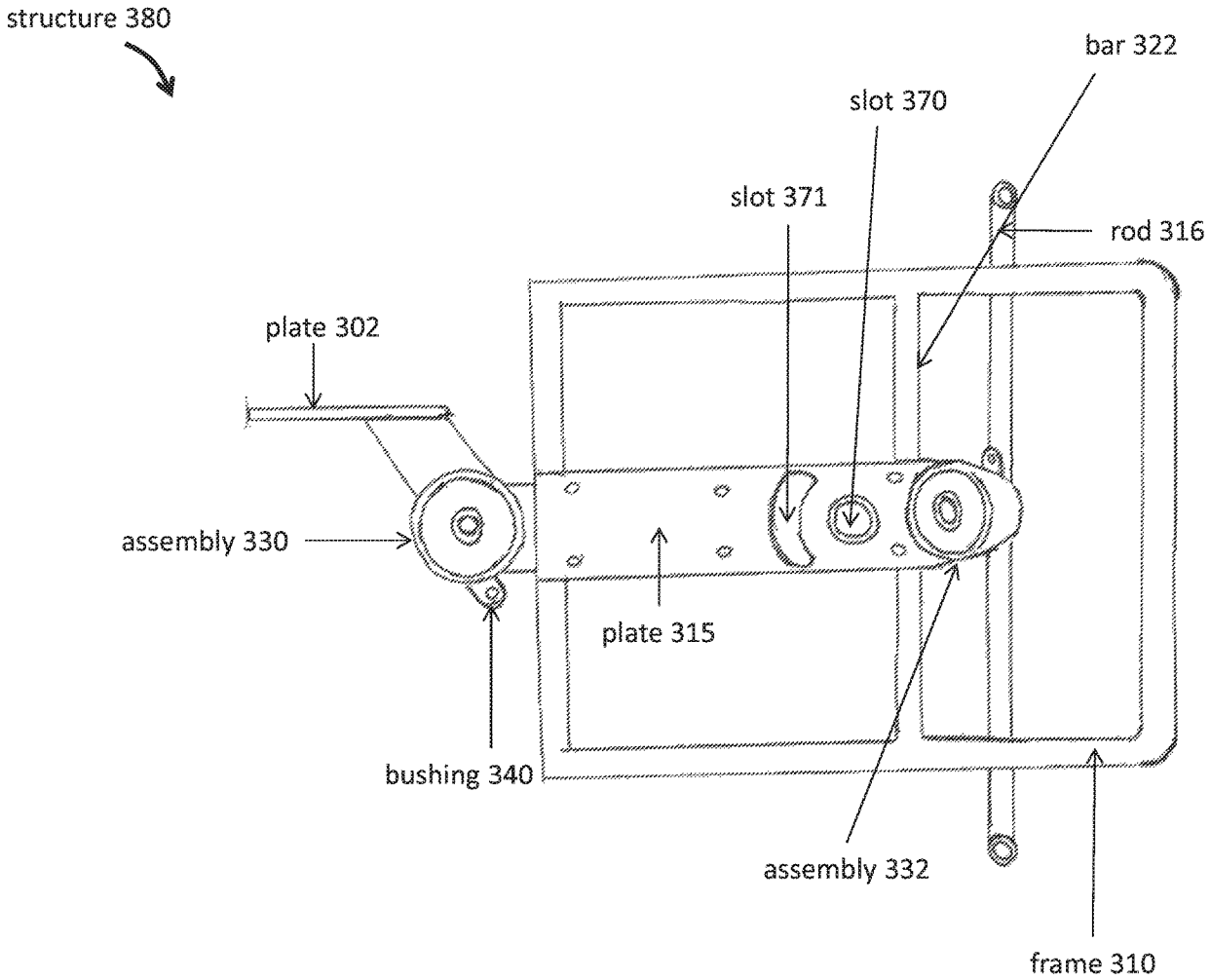
Figure 3E:
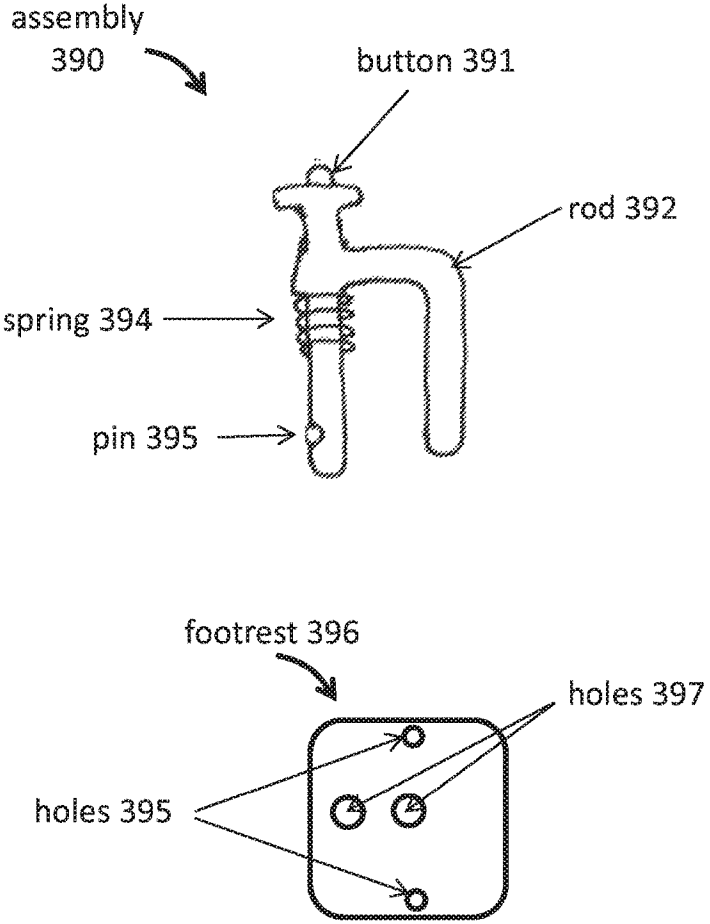
FIG. 3E illustrates a close up view of an assembly and a footrest included in a wheelchair configured for attaching the propulsion attachment to the wheelchair according to examples of the disclosure.

FIGS. 3A-1 to 3A-2 illustrate an exemplary process for forming the propulsion attachment according to examples of the disclosure. FIGS. 3B-3D illustrate sides and a top view of a propulsion attachment according to examples of the disclosure. FIG. 3E illustrates a close up view of an assembly and a footrest included in a wheelchair configured for attaching the propulsion attachment to the wheelchair according to examples of the disclosure.

The frame can be formed (step 352 of process 350). A tube can be bent in multiple locations to form a plurality of frames (e.g., frame 310 and frame 311). In some examples, the frames can be squares. The seams of the tube can be welded together. The two frames can be laid on top of one another and one side (e.g., front 314) of the plurality of frames can be welded together. The rear (e.g., rear 321) of the welded frames can be bent. Plate 322 can be connected to frame 311 and can be configured to support assembly 330. In some examples, plate 322 can be a 2"×⅛" metal plate.

In some examples, the rear of the welded frames can be bent up such that a 1" gap is created between the frames (e.g., frame 310 and frame 311). A plurality of supports (e.g., support 312) can be located between the frames (e.g., frame 310 and frame 311) and welded to the frames. In some examples, the plurality of supports can be located at the corners of the frames towards the rear (e.g., rear 321). A plate (e.g., plate 321) can be welded to the bottom frame (e.g., frame 311). A hole can be drilled into the plate. In some examples, the hole can be 5/16" in diameter and can be located in the center of the plate.

A rod (e.g., rod 316) can be welded across the bottom frame (e.g., frame 311). In some examples, the rod can be located 3" from the front of frame 211. A plurality of supports (e.g., support 313) can be welded to the ends of the rod. In some examples, each support can include tubing with a 1" length, such that the gap between a plate (e.g., plate 315) and the bottom frame (e.g., frame 211) is 1".

A plate (e.g., plate 315) can be bent to form a 90° bend on one side. In some examples, the bent end of the plate can have a 1" height. The bent end of the plate (e.g., plate 315) can be welded to the rear end (e.g., rear 321) of the top frame (e.g., frame 310). In some examples, the plate can be centered. The plate can be cut and aligned to be flush with the plurality of supports (e.g., support 313). In some examples, the plate and the plurality of supports can create a 30° angle. A hole (e.g., slot 370) can be drilled into the plate. In some examples, the hole can be ⅝" in diameter. In some examples, the hole can be located ½" from the front of the plate (e.g., plate 315).

A tube can be inserted in the hole (e.g., slot 370) and welded to it. A half circle opening (e.g., slot 371) can be cut in the plate (e.g., plate 315). In some examples, the half circle opening can be ⅝" wide. In some examples, the half circle opening can be located 2" behind the first slot (e.g., slot 370). A second plate can be bent to form a half circle, and can be welded to the open half circle opening. In some examples, the second plate can be ⅛" flat bar with a ¾" width. A third plate (e.g., plate 203) can be cut to form a square and welded to the bottom frame (e.g., frame 211).

A first assembly (e.g., assembly 330) can be formed (step 354 of process 350). A first piece of tubing can be welded onto a second piece of tubing. In some examples, the first piece of tubing can be a 1¼" tubing with 3" length, and the second piece of tubing can be 3". In some examples, the first and second tubing can form a 45° angle. The welded tubing can be pressed into bearing races, a notch can be formed, and then the first assembly can be welded to the first plate (e.g., plate 315) and/or first support (e.g., support 313). In some examples, the first assembly can be welded to the first plate and/or first support such that a 35° angle is formed.

A piece of tubing can be located horizontal to the first assembly (e.g., assembly 330) and welded. In some examples, the piece of tubing can have a 3" length. In some examples, the piece of tubing can be welded such that a 45° angle is formed. A plate (e.g., plate 302) can be welded to the piece of tubing. Bearings can be installed by sliding a bolt onto the welded rear of the bottom frame (e.g., frame 311) and then securing with nuts and washers. A hole can be cut into the plate (e.g., plate 302). In some examples, the hole can be the same size and shape as the gearbox. A plurality of holes can be drilled into the plate. In some examples, the plurality of holes can have the same pattern as the gearbox mounting holes. The motor and gearbox can be mounted onto the plate (e.g., plate 302) (step 356 of process 350). The plate, motor, and gearbox can be aligned. In some examples, the alignment can result in the center of the drive shaft protruding out of the gearbox by 4½" from the bearing cylinder and 3" off the floor.

The first assembly (e.g., assembly 330) can be attached by welding a bushing to the plate (e.g., plate 302) (step 358 of process 350). In some examples, the bushing can have ¼" thick wall, ½" length, and ⅜" diameter. In some examples, the bushing can be mounted 1" from the top of the bearing race. A plurality of plates (e.g., plate 205 and plate 206) configured to attach a rod (e.g., rod 216) can be formed by cutting the plates to the targeted size (e.g., 1" square) and drilling holes into each plate. In some examples, the holes can be ¼" holes. In some examples, three holes can be drilled. In some examples, two ⅜" holes can be drilled on each end of the plates and one 1/15" hole can be drilled behind one of the two ⅜" holes. The axles and rods can be attached to the plurality of plates to form the steering arm (step 360 of process 350). An axle (e.g., axle 244 and axle 245) can be inserted into a hole (e.g., the 1/15" hole). The rod (e.g., rod 216) can be attached to the plates (e.g., plate 205 and plate 206) using the other holes (e.g., ⅜" holes), bushings, washers, and locknuts. In some examples, the axles can be positioned such that the treaded sides are facing towards the outer sides of propulsion attachment 200.

Three rods (e.g., rod 217, rod 218, and rod 219) can be assembled to connect the steering arm to the first assembly (e.g., assembly 330). The rods can be cut to have a length such that when the heim joints are screwed on the ends, the axles are square with the frame of propulsion attachment.

The handlebar can be formed (step 362 of process 350) by attaching a first bar (e.g., bar 220) to a second bar (e.g., bar 223), such that the first bar is oriented perpendicular to the second bar. One end of the first bar can be squeezed to form an oval, and the second bar can be welded to the first bar. The brake lever (e.g., lever 254) can be installed (step 364 of process 350). The throttle (e.g., throttle 255) can be installed (step 366 of process 350). Handles (e.g., handle 253) and/or handgrips can be installed (step 368 of process 350). A hole can be drilled into the opposite end of first bar (e.g., bar 220) than where the second bar (e.g., bar 223) is located. In some examples, the hole can be a ¼" hole located 2" from the opposite end and centered 90° with the first bar and the second bar.

The second assembly (e.g., assembly 332) can be formed (step 370 of process 350). A plate (e.g., plate 301) can be welded to a piece of tubing (e.g., bar 333). In some examples, the plate can be a 2"×⅛" thick disk. In some examples, the piece of tubing can be threaded on one end and notched on the other end. In some examples, the piece of tubing can be 11/16" tubing with a 6" length. A plurality of holes can be drilled side-by-side in the plate. In some examples, the plurality of holes can be two ¼" holes. In some examples, the holes can be facing forward 120° from the center of propulsion attachment 200. Another hole in the plate can be drilled for the rear steering arm. The steering arm (e.g., rod 216, rod 217, rod 218, and rod 219) can be bolted on with heim joints to the plate (e.g., plate 301). A no-spin washer can be placed between two nuts, and both the nuts and washer can be threaded up the tube (e.g., bar 333) with the bearing races located on the front top of frame.

A hole for a button (e.g., button 372) can be drilled in the back of the recessed threaded end of the tube (e.g., bar 333). In some examples, the hole can be a ¼" hole located 1" down from the top of the tube (e.g., bar 333). In some examples, the button can be a quick release button. The bar (e.g., bar 220) of the handlebar can slide down over the threaded tube (e.g., bar 333) until the button meets the hole.

The rear wheel can be formed (step 372 of process 350). A hole can be drilled into a plate (e.g., plate 207). In some examples, the hole can be a 5/16" hole. In some examples, the plate can be a 3"×⅛" thick metal disk. A tube and a woodruff key groove can be welded through the hole. A plurality of half bolt patterns can be drilled into the plate (e.g., plate 207). In some examples, the half bolt pattern can include ¼" holes. In some examples, the half bolt pattern can correspond to the wheel pattern (e.g., wheel 252). The plate can be bolted between two wheel halves, where the wheel halves exclude bearings. The tire and inner tube can also be included and can bolt the brake drum from the outer side of the wheel half. The tire and inner tube can be inflated. With the woodruff key in place, the gearbox (e.g., gearbox 279) can be mounted. In some examples, the gearbox can be mounted in the space between the motor (e.g., motor 278) and the crossbar. The rear brake (e.g., brake 272) can be slid on over the drum and welded to the forward end of the spindle. The brake cable can be installed.

The batteries (e.g., battery 275 and battery 276) can be installed by adhering the batteries to the bottom plate (e.g., plate 203) inside the bottom frame (e.g., frame 311) (step 374 of process 350). In some examples, silicone can be used for adhering the batteries. The controller (e.g., controller 277) can be attached to the propulsion attachment. In some examples, silicone can be used for adhering the batteries. In some examples, the controller can be located near the handlebar.

The front brakes (e.g., brake 273 and brake 274) can be installed (step 376 of process 350). Each brake can be welded to an associated plate. For example, brake 273 can be welded to plate 205, and brake 274 can be welded to plate 205. The controller can be connected to one or more components (step 378 of process 350). Wiring (e.g., wiring 242 and wiring 243) can be coupled to the brakes and can be connected to the controller (e.g., controller 277). Wiring for the batteries (e.g., battery 275 and battery 276) can be connected by attaching the negative pole of one battery to the positive pole of the other battery, and then the opposite poles are connected to the controller (e.g., controller 277). The controller (e.g., controller 277) can be connected to the motor (e.g., motor 278) and can also be connected to the throttle (e.g., throttle 255).

A hole (e.g., slot 270) and half circle hole (e.g., slot 271) can be drilled into a plate (e.g., plate 204). A third assembly (e.g., assembly 390) can be formed (step 380 of process 350). A rod (e.g., rod 392) can be bent. In some examples, the rod can include a ⅝" shaft and a ¾" rod. In some examples, the rod can be bent 90°. A pin (e.g., pin 395) can be welded onto the side of assembly 390. A spring (e.g., spring 394) can be brazed onto the shaft. A plurality of holes (e.g., holes 395 and holes 397) can be drilled into the footrest of the wheelchair (step 382 of process 350). In some examples, some of the plurality of holes (e.g., holes 395) can match the measurements of the pin (e.g., pin 395).

Figure 4:
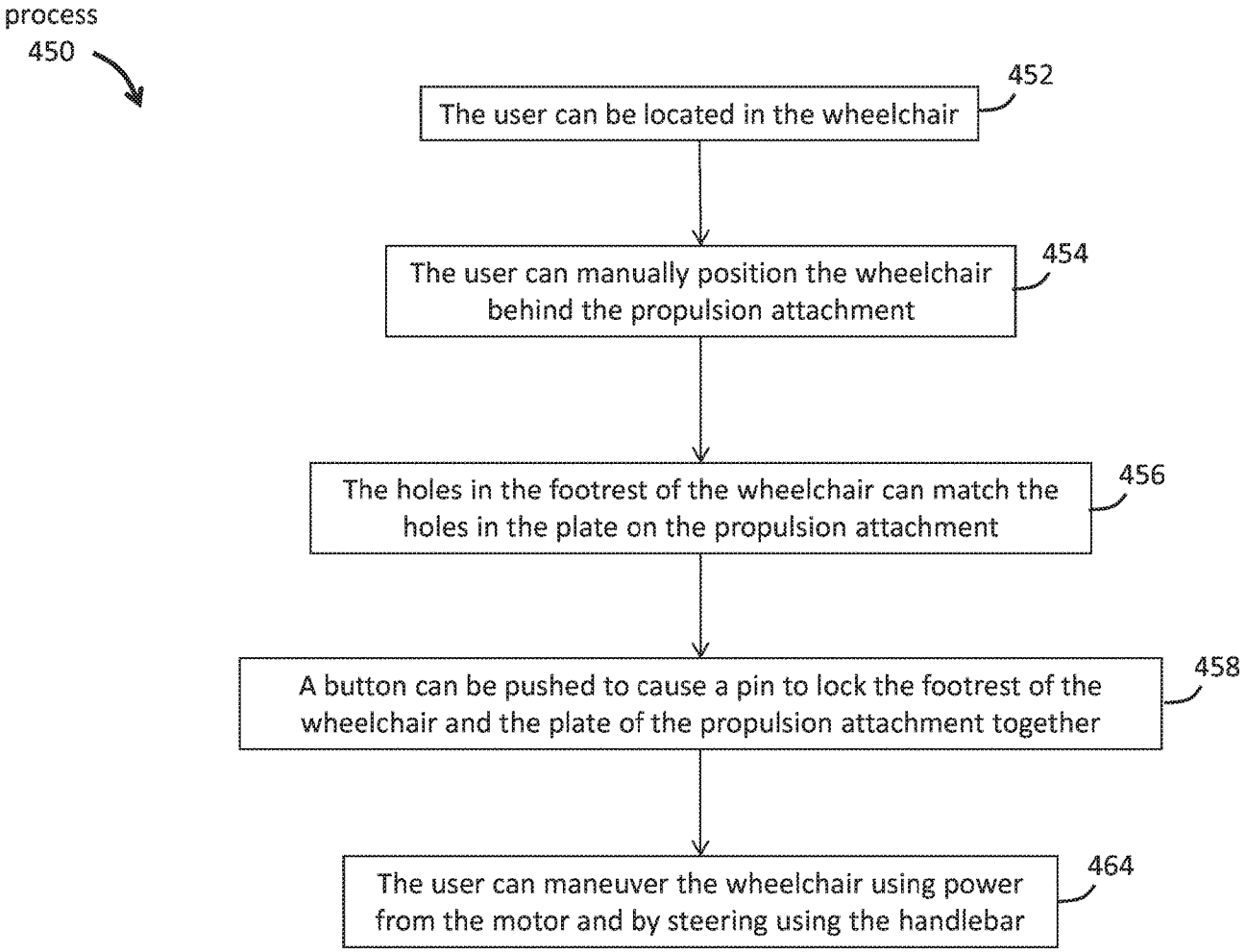
FIG. 4 illustrates an exemplary process flow for attaching the propulsion attachment to the wheelchair according to examples of the disclosure.

FIG. 4 illustrates an exemplary process flow for attaching the propulsion attachment to the wheelchair according to examples of the disclosure. The user can be located in the wheelchair (step 452 of process 450). The user can manually position the wheelchair behind (i.e., opposite side of the handlebar) the propulsion attachment (step 454 of process 450). In some examples, manually positioning the wheelchair can include lifting the front of the wheelchair and landing the footrest (e.g., footrest 396) onto a plate (e.g., plate 204). The user can manually position the wheelchair such that holes in the footrest (e.g., footrest 396) are centered with the holes in the plate (e.g., plate 315) (step 456 of process 450). The button (e.g., button 372) can be pushed to cause the pin (e.g., pin 395) to lock the footrest and plate together. In some examples, the user can pull the pin to ensure that the footrest and plate are locked. The user can maneuver the wheelchair using the power from the motor (included in the propulsion attachment) and by manually steering using the handlebar (step 458 of process 450). The speed changed by operating the throttle and/or lever located on the handlebar.

A propulsion apparatus for powering a manual wheelchair is disclosed. The propulsion apparatus can comprise: three wheels including first and second wheels located on one end of the propulsion attachment and a third wheel located on an opposite end of the propulsion attachment; a motor that drives the third wheel; a gearbox that transmits power from one or more batteries to the motor; and a controller that controls the motor and the gearbox, wherein the propulsion attachment is capable of attaching to and detaching from the manual wheelchair. Additionally or alternatively, in some examples, the propulsion apparatus further comprises: a plate comprising a plurality of holes having a pattern, the pattern matching a pattern on a footrest of the wheelchair; and an assembly including a pin, spring, and button, the assembly configured to lock the footrest and the plate together. Additionally or alternatively, in some examples, the one or more batteries include two removable batteries coupled to the controller. Additionally or alternatively, in some examples, the one or more batteries are 12 volt batteries. Additionally or alternatively, in some examples, the apparatus further comprises: an upper frame and a lower frame, wherein the one or more batteries are located between the upper frame and the lower frame. Additionally or alternatively, in some examples, the upper frame is angled relative to the lower frame. Additionally or alternatively, in some examples, at least one wheel included in the wheelchair floats when the apparatus is attached to the wheelchair. Additionally or alternatively, in some examples, the wheelchair includes a front end, the front end located closer to a footrest of the wheelchair than a seat of the wheelchair and the wheel chair includes two front wheels located at the front end, wherein a spacing between the first and second wheels of the apparatus is greater than a spacing between the two front wheels of the wheelchair. Additionally or alternatively, in some examples, the propulsion apparatus operates with rear wheel drive in a forward direction. Additionally or alternatively, in some examples, the propulsion apparatus further comprises: three brakes, each brake coupled to one of the three wheels. Additionally or alternatively, in some examples, the propulsion apparatus further comprises: a handlebar coupled to the first and second wheels, the handlebar including: a throttle configured to control a speed of the propulsion attachment, and a lever configured to control the three brakes, wherein the handlebar is configured to allow a user to steer the propulsion apparatus. Additionally or alternatively, in some examples, the third wheel is located under a seat of the wheelchair. Additionally or alternatively, in some examples, wherein the wheelchair includes a front end, the front end located closer to a footrest of the wheelchair than a seat of the wheelchair, and wherein a handlebar and the first and second wheels are located towards the front end and protrude from the wheelchair. Additionally or alternatively, in some examples, the apparatus is capable of standing upright when detached from the wheelchair. Additionally or alternatively, in some examples, the apparatus is capable of operating at variable speeds. Additionally or alternatively, in some examples, the apparatus is capable of powering the wheelchair to move in a forward direction and a reverse direction.

A method for powering a manual wheelchair is disclosed. The method can comprise: providing a propulsion apparatus, the propulsion apparatus capable of attaching to and detaching from the wheelchair; positioning a footrest of the wheelchair on top of a plate included in the propulsion attachment; and pushing a button to engage a pin to lock the footrest to the plate. Additionally or alternatively, in some examples, the method further comprises: changing a speed of the wheelchair and propulsion apparatus by operating a throttle located on a handlebar of the propulsion apparatus. Additionally or alternatively, in some examples, the method further comprises: steering the wheelchair and propulsion apparatus by manually moving a handlebar of the propulsion apparatus. Additionally or alternatively, in some examples, the method further comprises: lowering a power transferred from the propulsion apparatus to the wheelchair by operating a lever located on a handlebar of the propulsion apparatus.

While various examples have been described above, it should be understood that they have been presented by way of example only, and not by way of limitation. Although examples have been fully described with reference to the accompanying drawings, the various diagrams can depict an example architecture or other configuration for this disclosure, which is done to aid in the understanding of the features and functionality that can be included in the disclosure. The disclosure is not restricted to the illustrated exemplary architectures or configurations, but can be implemented using a variety of alternative architectures and configurations. Additionally, although the disclosure is described above in terms of various examples and implementations, it should be understood that the various features and functionality described in one or more of the examples are not limited in their applicability to the particular example with which they are described. They instead can be applied alone or in some combination, to one or more of the other examples of the disclosure, whether or not such examples are described, whether or not such features are presented as being part of a described example. Thus, the breadth and scope of the present disclosure should not be limited by any of the above-described examples.

What is claimed is:

1. A propulsion apparatus for powering a manual wheelchair, the propulsion apparatus comprising:

two front wheels located at a front end of the propulsion attachment;

a rear wheel located on a back end of the propulsion attachment, the back end opposite the front end;

three brakes, each brake attaches to one of the two front wheels or the rear wheel;

a motor that drives the rear wheel such that it pushes the propulsion apparatus when operated in a forward direction and pulls the propulsion attachment when operated in a rear direction;

a gearbox that transmits power from the motor to the rear wheel;

a controller that controls the motor and the gearbox;

an assembly including a single pin; and a plate including a plurality of holes, one hole for receiving the single pin of the assembly to attach the propulsion apparatus to a footrest of the manual wheelchair.

2. The propulsion apparatus of claim 1, wherein the plurality of holes included in the plate has a pattern, the pattern matching a pattern on the footrest of the manual wheelchair, and wherein the assembly includes the single pin, a spring, and a button, the assembly locks the footrest and the plate together.

3. The propulsion apparatus of claim 1, further comprising two removable batteries coupled to the controller.

4. The propulsion apparatus of claim 1, further comprising one or more batteries coupled to the controller, wherein the one or more batteries are 12 volt batteries.

5. The propulsion apparatus of claim 1, further comprising:

an upper frame and a lower frame; and one or more batteries located between the upper frame and the lower frame.

6. The propulsion apparatus of claim 5, wherein the upper frame is angled relative to the lower frame.

7. The propulsion apparatus of claim 5, wherein two front wheels included in the manual wheelchair float when the propulsion apparatus is attached to the manual wheelchair.

8. The propulsion attachment of claim 1, wherein the manual wheelchair includes:

a front end, the front end of the manual wheelchair located closer to the footrest of the manual wheelchair than a seat of the manual wheelchair, and two front wheels located at the front end, wherein a spacing between the two front wheels of the propulsion apparatus is greater than a spacing between the two front wheels of the manual wheelchair.

9. The propulsion apparatus of claim 1, further comprising:

a handlebar coupled to the two front wheels, the handlebar including:

a throttle to control a speed of the propulsion attachment, and a lever to control the three brakes, wherein the handlebar allows a user to steer the propulsion apparatus.

10. The propulsion apparatus of claim 1, wherein the rear wheel of the propulsion apparatus is located under a seat of the manual wheelchair when the propulsion apparatus is attached to the manual wheelchair.

11. The propulsion apparatus of claim 1, wherein the manual wheelchair includes a front end, the front end of the manual wheelchair located closer to the footrest of the manual wheelchair than a seat of the manual wheelchair, and wherein a handlebar and the two front wheels of the propulsion apparatus are located in front of the front end of the manual wheelchair when the propulsion apparatus is attached to the manual wheelchair.

12. The propulsion apparatus of claim 1, wherein the propulsion apparatus is capable of standing upright when detached from the manual wheelchair.

13. The propulsion apparatus of claim 1, wherein the propulsion apparatus is configured to operate at variable speeds.

14. The propulsion apparatus of claim 1, wherein the propulsion apparatus is capable of angular turning relative to an axis from the manual wheelchair to the propulsion apparatus while the propulsion apparatus is attached to the manual wheelchair.

* * * * *